US005609296A

United States Patent [19]

Imamura et al.

[11] Patent Number: 5,609,296

[45] Date of Patent: Mar. 11, 1997

[54] WATER FEED DEVICE FOR HUMIDIFICATION AND AIR CONDITIONING APPARATUS INCORPORATING THE SAME

[75] Inventors: Toshihide Imamura; Kanichi Kadotani; Bunji Hayakashi; Hisaakira Imaizumi; Tetsuo Shakushi; Toshihiko Matsumoto; Genichiro Watanabe, all of Kanagawa-ken, Japan

[73] Assignee: Komatsu, Ltd., Tokyo, Japan

[21] Appl. No.: 537,865

[22] PCT Filed: Aug. 11, 1994

[86] PCT No.: PCT/JP94/01336

§ 371 Date: Jan. 22, 1996

§ 102(e) Date: Jan. 22, 1996

[87] PCT Pub. No.: WO95/05563

PCT Pub. Date: Feb. 23, 1995

[30] Foreign Application Priority Data

Aug. 12, 1993 [JP] Japan ..... 5-200741
Aug. 12, 1993 [JP] Japan ..... 5-200752

[51] Int. Cl.[6] ..... A24F 25/00; F24F 6/08

[52] U.S. Cl. ..... 239/43; 165/DIG. 171; 239/44; 261/70; 392/395

[58] Field of Search ..... 62/188, 315; 165/DIG. 171; 261/70; 239/43, 38, 44; 392/395

[56] References Cited

U.S. PATENT DOCUMENTS

| | | | |
|---|---|---|---|
| 987,433 | 3/1911 | Crawford | 239/38 X |
| 4,651,819 | 3/1987 | Yumikura et al. | 165/DIG. 171 |
| 5,203,505 | 4/1993 | Yum | 239/43 |

FOREIGN PATENT DOCUMENTS

| | | |
|---|---|---|
| 2-8642 | 1/1990 | Japan . |
| 2-1113 | 1/1990 | Japan . |
| 3-530 | 1/1991 | Japan . |
| 3-20228 | 2/1991 | Japan . |

*Primary Examiner*—William E. Wayner
*Attorney, Agent, or Firm*—Armstrong, Westerman, Hattori, McLeland & Naughton

[57] ABSTRACT

There is provided a water feed device for humidification, comprising: an outflow reservoir that is disposed above a humidifier for feeding water into the humidifier by way of a permeation and that is provided with an overflow dam for maintaining a level of the water in the outflow reservoir substantially constant; an inflow reservoir that is disposed upwards of the outflow reservoir and that is provided with a flow inlet; a partition plate that is disposed between the inflow reservoir and the outflow reservoir; and a plurality of drip feed members which are provided in the partition plate for allowing the water in the inflow reservoir to drop by gravity in a form of droplets into the outflow reservoir. There is also provided an air conditioning apparatus having a dehumidifier, a heater, a humidifier and an air blower successively arranged within an air duct connect to an area to be air conditioned; downwards of respective portions of the cooling dehumidifier unit and the humidifier unit in the air duct there are provided a pair of water proof trays, respectively, which are communicated via respective hoses with the cooling dehumidifier unit and the humidifier unit, respectively, and which are provided with a drainage means that is opening to an outside of the housing; and downwards of the water proof trays and downwards of the air duct there is provided a further water proof tray having a drainage means that is opening to an outside of the housing.

3 Claims, 6 Drawing Sheets

WATER FEED DEVICE FOR HUMIDIFICATION AND AIR CONDITIONING APPARATUS INCORPORATING THE SAME

TECHNICAL FIELD

The present invention relates to a water feed device for humidification and an air conditioning apparatus incorporating the same. Here, the water feed device for humidification may be designed for use, for example, in a bid-cultivating chamber, a clean room (box), a constant temperature and isohumid box for temperature and humidity control, an air conditioning unit for ultra high precision cutting, a semiconductor wafer manufacturing system and so forth. The water feed device for humidification is used with a humidifier unit for effecting a humidification while vaporizing pure water or ultra pure water and is adapted to feed into the humidifier unit such pure water serving as the humidifying water. The air conditioning apparatus here may be associated with a spin coating system that is designed to coat a regist upon a surface of a semiconductor while rotating the same or to apply a coating material upon a substrate of an optical disk, and which is able to feed a constant temperature and isohumid air stream into any of a variety of operating stations that are included in such systems.

BACKGROUND ART

In case where it is desirable to feed a given amount of water into a reservoir and so forth, it has been customary to use a pump.

In case where water is fed through a pump, there is no difficulty in controlling the rate of flow of the water. This is not the case, however, where the water is pure water or ultra pure water. Then, a pump is not suitable for use in feeding the water.

This is attributed to the fact that pure water unlike normal water does not contain an impurity which serves to provide a lubricating function for a sliding surface contained in a pump and so forth. Thus, if pure water is fed through a unit, such as a customary pump, which involves a mechanical friction, there has been encountered the problem that the pump or the like unit is low in its durability and does cause the pure water to be contaminated due to a wear of a component thereof. Should the pure water be ever fed through the pump or the like, a prohibitively large feed equipment would be required, and its system and operation would be prohibitively costly.

Besides, in this conjunction, while a tube pump is non-contaminative to pure water, it must be taken into account that the same is poor in its durability and in addition is inconvenient in that a pulsation takes place unavoidably.

Furthermore, in case where a unit for feeding water through a pump is used with a humidifier unit in which a heating wire made up from a metal or the like is brought into direct contact with water, the problem is brought about that an electrical leakage may sometimes take place externally via the pure water. Thus, pure water (with its resistance value of 18 ohm) is by no means an insulator and, if carbon dioxide in the air is absorbed therein, it will have its resistance value further reduced to one tenth. Hence, the problem of an electrical leakage tends always to be brought about.

An air conditioning apparatus of the conventional design has been constructed as shown, for example, in Japanese Unexamined Patent Publication No. Hei 02-1113. Thus, it typically comprises a cooling dehumidifier unit for cooling an intake air flow to dehumidify the cooled air flow, a heating unit for heating to a predetermined temperature the air flow that has been dehumidified by the cooling dehumidifier unit, a humidifier unit for humidifying the resulting air flow to a predetermined humidity and an air blower unit for feeding the humidified air flow.

And, in the conventional air conditioning apparatus, the air blower unit, the cooling dehumidifier unit that comprises a heat exchanger for a cooling purpose, the heating unit that comprises a heat exchanger designed to adjust the air temperature, and the humidifier unit are successively arranged in a vertical direction within a cylindrical housing so that a vertical laminar flow of which the temperature and the humidity are controlled may be fed to an area to be air conditioned, such as a spin coating system as mentioned above, that is positioned downwards of these components.

In an conventional air conditioning apparatus as mentioned above, however, it must be noted that the water which is removed from the air and condensed at the cooling dehumidifier unit has no way but to be allowed to drop downwards and, if this water happens to adhere onto a temperature and humidity sensor which is provided in the heating unit or the housing, it follows that an accuracy at which the temperature and the humidity are controlled could significantly be lowered. Also, if the above mentioned water happens to get mixed with the conditioned air flow to adhere onto a filter that is provided at an outlet of the housing, the problem has arisen that the filter may be clogged, thus significantly lowering the rate of the air flow being fed.

It is a first object of the present invention to provide a water feed device for humidification, which eliminates a need for a mechanical water feed unit, is capable of feeding a given quantity of pure water into an evaporation zone in an inexpensive arrangement, and may not generate an accident due to the electrical leakage.

Also, it is a second object of the present invention to provide an air conditioning apparatus whereby if water droplets happen to fall by gravity from any of a variety of the components of an air conditioning system including the cooling dehumidifier, they could not adhere onto the heating unit or the temperature and humidity sensing means which are provided in the housing and could not be introduced into the conditioned air flow at the outlet side to produce a clogging of the filter or to induce any other adverse effect; there could be no influence from the moisture condensed water at all; and an increased precision at which a temperature and a humidity are controllable is assured.

SUMMARY OF THE INVENTION

In order to attain the first object mentioned above, a water feed device for humidification according to the present invention comprises: an outflow reservoir that is disposed above a humidifier for feeding water into the said humidifier by way of a permeation and that is provided with an overflow dam for maintaining a level of the water in the said outflow reservoir substantially constant; an inflow reservoir that is disposed upwards of the said outflow reservoir and that is provided with a flow inlet; a partition plate that is disposed between the said inflow reservoir and the said outflow reservoir; and a plurality of drip feed members which are provided in the said partition plate for allowing the water in the said inflow reservoir to drop by gravity in a form of droplets into the said outflow reservoir. According to the construction mentioned above, it follows that the water from the said inflow reservoir is allowed to drop in the form of the droplets into the said outflow reservoir whereas an excessively fed portion of the water is allowed to overflow the said overflow dam. Accordingly, the water in the said outflow reservoir is held in a given quantity and in a substantially static state. It follows, therefore, that the rate of feed of the water into the humidifier disposed downwards of the said outflow reservoir can be substantially constant. Thus, a need for a mechanical water feed unit such as a pump is eliminated and it is possible to feed a given amount of pure water into a vaporization zone of a humidifier in an inexpensive arrangement. In the humidifier, therefore, a high precision humidity can be maintained substantially constant.

Also, in addition to the construction mentioned above, it is preferred that the said inflow reservoir and the said outflow reservoir be each made up from an insulating material; and that said inflow reservoir and said outflow reservoir have each an inner surface that has been treated so as to be hydrophobic.

According to this construction, an electrical leakage that may otherwise be transmitted from the said outflow reservoir to the said inflow reservoir via the water can be eliminated owing to the fact that the feed of the water into the said outflow reservoir is carried out in the form of the droplets and no continuous water film is formed between the said inflow reservoir and the said outflow reservoir. Hence, it can be made unnecessary to utilize an expensive insulating transformer and so forth.

It is also desirable that the said inflow reservoir be provided therein with a float switch for detecting a level of the water in the said inflow reservoir whereas the said flow inlet be provided thereat with an on/off valve, the said on/off valve being controllable in response to a signal from the said float switch for controlling a rate of inflow of the water from the said flow inlet into the said inflow reservoir.

In order to attain the second object mentioned above, an air conditioning apparatus according to the present invention is characterized in that a cooling dehumidifier unit, a heater unit, a humidifier unit and an air blower unit are successively arranged within an air duct which is provided in a horizontal direction in a housing; that the said air duct is provided with an outlet side that is connected to an outlet duct which is opening towards an area to be air conditioned; that downwards of respective portions of the said cooling dehumidifier unit and the said humidifier unit in the said air duct there are provided a pair of water proof trays, respectively, which are communicated via respective hoses with the said cooling dehumidifier unit and the said humidifier unit, respectively, and which are provided with a drainage means that is opening to an outside of the said housing; and that downwards of the said water proof trays and downwards of the said air duct there is provided a further water proof tray having a drainage means that is opening to an outside of the said housing.

According to the construction mentioned above, it can been seen that if water droplets happen to fall by gravity from any of a variety of the components of an air conditioning system including the cooling dehumidifier unit, they will be accepted by one or both of the said trays and will thereafter be discharged out of the housing. Hence, it follows that such water droplets may not adhere onto the temperature and humidity sensing means provided in the heater or the housing and may not be introduced into the conditioned air flow at the outlet side to produce a clogging of the filter or to induce any other adverse effect; there could thus be no influence from the moisture condensed water at all; and an increased precision at which a temperature and a humidity are controllable is assured.

In connection with the above, it may be noted that it is desirable that the said outlet duct be directed downwards and have a forward end thereof which is provided with a filter. It is also desirable that there be provided a temperature and humidity sensing means in the said outlet duct; and that each of the above mentioned units be adapted to be controlled by the said power supply controller in response to a value of detection of the said temperature and humidity sensing means. Alternatively, it may be desired that there be provided a temperature and humidity sensing means downwards of and in the proximity of the said filter; and that each of the units mentioned above be adapted to be controlled by the said power supply controller in response to a value of detection of the said temperature and humidity sensing means.

Furthermore, an air conditioning apparatus according to the invention may be characterized in that a cooling dehumidifier unit, a heating unit, a humidifier unit and an air blower unit are successively arranged within an air duct which is provided in a housing in a horizontal direction; that the said air duct is provided with an outlet side that is connected to an outlet duct which is opening towards an area to be air conditioned; that downwards of respective portions of the said cooling dehumidifier unit and the said humidifier unit in the said air duct there are provided a pair of water proof trays, respectively, which are communicated via respective hoses with the said cooling dehumidifier unit and the said humidifier unit, respectively, and which arc provided with a drainage means that is opening to an outside of the said housing; that downwards of the said water proof trays and downwards of the said air duct there is provided a further water proof tray having a drainage means that is opening to an outside of the said housing; and the said apparatus is associated with a water feed device for the said humidifier unit, which device comprises: an outflow reservoir that is disposed above the said humidifier unit for feeding water into the said humidifier unit by way of a permeation and that is provided with an overflow dam for maintaining a level of the water in the said outflow reservoir substantially constant; an inflow reservoir that is disposed upwards of the said outflow reservoir and that is provided with a flow inlet; a partition plate that is disposed between the said inflow reservoir and the said outflow reservoir; and a plurality of drip feed members which are provided in the said partition plate for allowing the water in the said inflow reservoir to drop by gravity in a form of droplets into the said outflow reservoir.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention with respect to the water feed device for humidification and the air conditioning apparatus incorporating the same will be set forth with reference to the accompanying drawings.

Figure 1:
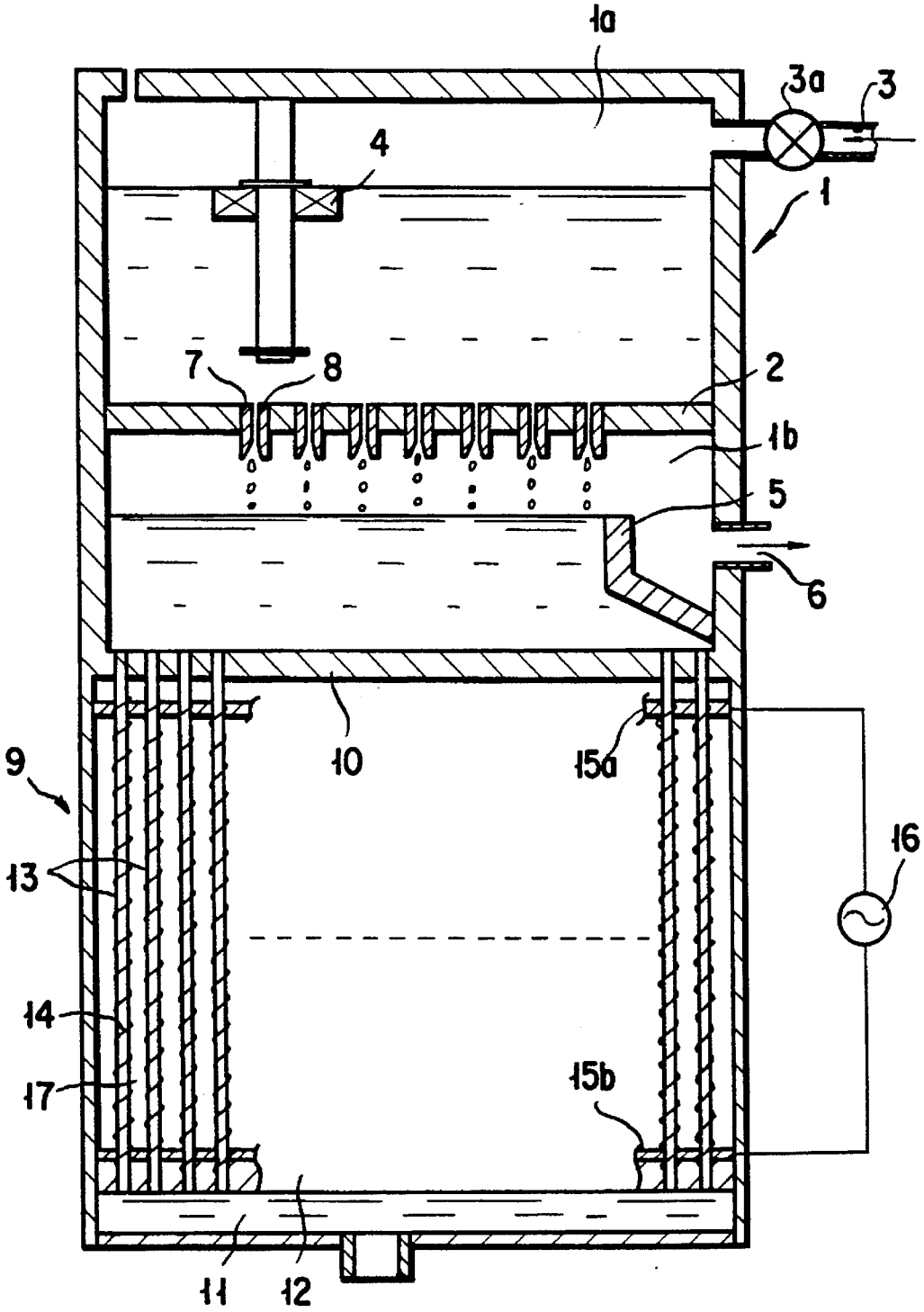
FIG. 1 is a cross sectional view illustrating a certain embodiment of the water feed device for humidification according to the present invention.

FIG. 1 shows a first embodiment of the water feed device for humidification according to the present invention.

As shown in the Figure, a water supply reservoir assembly, which is designated by reference numeral 1, is constructed so as to be electrically insulating and is divided into an upper and a lower part by a partition plate 2. Located at the upper part there is an inflow reservoir 1*a*, and lying at the lower part there is a outflow or discharge reservoir 1*b*. And, the inflow reservoir 1*a* is formed in a side wall thereof with a flow inlet 3 and is provided interiorly with a float switch 4 that is pendent from the top wall thereof for detecting a level of the water therein. In this connection, it should be noted that the flow inlet 3 is provided thereat with an on/off valve 3*a* which is adapted to be controlled in response to a signal from the float switch 4 for controlling the inflow rate of the water through the flow inlet 3. On the other hand, the outflow reservoir 1*b* is provided with an overflow dam 5 for maintaining a level of the water in the outflow reservoir 1*b* substantially constant and is formed in a side wall thereof with a flow outlet 6 for draining the water overflowing the overflow dam 5 into the outside thereof.

The above mentioned partition plate 2 is formed with a plurality of communicating ports 7 for communicating the upper reservoir 1*a* with the lower reservoir 1*b*. Each of the communicating ports 7 is fitted with a drip feed nozzle 8 that is opening expandingly downwards. Each of the drip feed nozzles 8 is made up from an insulating material and has its inner surface that has been treated so as to be of a hydrophilic nature. And, its bore diameter is dimensioned to be not greater than 2 mm and is so configured that the water passing therethrough may drop by gravity in the form of droplets. It should also be noted that both of the above mentioned upper and lower reservoirs 1*a* and 1*b* each have its inner surface that has been so treated as to be hydrophobic.

Downwards of the outflow or discharge reservoir 1*b* there is located a humidifier 9. In this humidifier 9, there are spanned a plurality of hollow textile thread bodies 13, which are each water permeable, between a bottom plate 10 of the outflow reservoir 1*b* and an upper plate 12 of a lower reservoir unit 11, with each hollow textile thread body 13 communicating between the outflow reservoir 1*b* and the lower reservoir unit 11. And, each of these hollow textile thread bodies 13 is wound throughout its whole length with a metallic wire 14 and each of the metallic wires 14 is connected via a pair of electrodes 15*a* and 15*b* to a power supply 16. Intermediate between the outflow reservoir 1*b* and the lower reservoir unit 11 there are formed air passageways 17 such that each of the hollow textile thread bodies 13 may be exposed with a wind that is passing therethrough.

In the construction mentioned above, the pure water that is introduced through the flow inlet 3 will naturally flow down to be charged in the inflow reservoir 1*a*. The inflow flow rate of the water introduced from the flow inlet 3 will be controlled by controlling the on/off valve 3*a* in response to a signal from the float switch 4 so that the level of the pure water in the inflow reservoir 1*a* may be maintained within a predetermined range at all the times. The pure water within the inflow reservoir 1*a* will be allowed to drop by gravity through the drip feed nozzles 8 formed in the partition plate 2 into the outflow reservoir 1*b*. And, the water level within this outflow reservoir 1*b* will be maintained substantially constant by means of the overflow dam 5, and the pure water overflowing the overflow dam 5 will be drained through the effluent outlet 6.

While the pure water within the outflow or discharge reservoir 1*b* is being allowed to flow down little by little through the hollow textile thread bodies 13, it will be permeated onto their individual surfaces. At the same time, the permeated pure water will be vaporized by means of the metallic wires 14 which generates heat with an electric current passed therethrough. It follows, therefore, that a wind traversing the passageways 17 will be humidified with a vapor of this pure water.

In the operation mentioned above, owing to the fact that feeding the pure water from the inflow reservoir 1*a* into the outflow reservoir 1*b* is carried out by its dropping through the drip feed nozzles 8, the pure water within the outflow or discharge reservoir 1*b* will be held in an extremely static state.

According to this embodiment of the present invention, it can thus be seen that the water from the inflow reservoir 1*a* is allowed to drop in the form of the droplets into the outflow reservoir 1*b* whereas an excessively fed portion of the water is allowed to overflow the overflow dam 5. Accordingly, the water in the outflow reservoir 1*b* is held in a given quantity and in a substantially static state. It follows, therefore, that the rate of feed of the water into the humidifier 9 disposed downwards of the outflow reservoir 1*b* can be substantially constant. Thus, a need for a mechanical water feed unit such as a pump is eliminated and it is possible to feed a given amount of pure water into a vaporization zone of the humidifier 9 in an inexpensive arrangement. In the humidifier 9, therefore, a high precision humidity can be maintained substantially constant.

Also, owing to the fact that the feed of water into the outflow or discharge reservoir 1*b* is by way of a dripping as mentioned above, it will be seen that if the pure water within the outflow reservoir 1*b* is elevated in its electrical potential due to an electrical leakage from the heating portion of the humidifier 9, there will be no electrical leakage whatsoever from the dripping portion up to the inflow reservoir 1*a*. As a consequence, there will be no electrical leakage whatsoever outwards via the pure water that is introduced through the flow inlet 3 of the inflow reservoir 1*a*.

It can also be seen that since both of the inflow reservoir 1*a* and the outflow reservoir 1*b* have each its inner surface rendered hydrophobic, the water will not adhere onto either inner surface of both of the two reservoirs 1*a* and 1*b* so that there may develop no continuous film of the water between the two reservoirs 1*a* and 1*b*, thus preventing whatsoever electrical leakage that may otherwise be produced through their respective inner surfaces.

Figure 2:
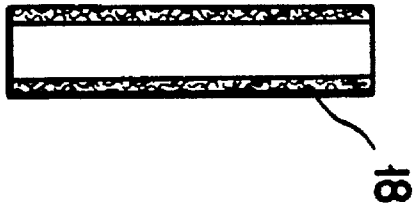
FIG. 2 is a cross sectional view illustrating an alternative embodiment of a drip feed member in the above mentioned embodiment of the present invention.

The drip feed nozzles 8 in the above mentioned construction may be made up from a rigid material, such as a high polymer, for example, 6-nylon or 66-nylon, or a polypropylene, whose surface has been treated so as to be hydrophilic. As shown in FIG. 2, however, they may alternatively be either hollow. fibrous threads 18 or non-hollow fibrous members. In any case, a note is taken here of the fact that they have been treated so as to be hydrophilic.

Figure 3:
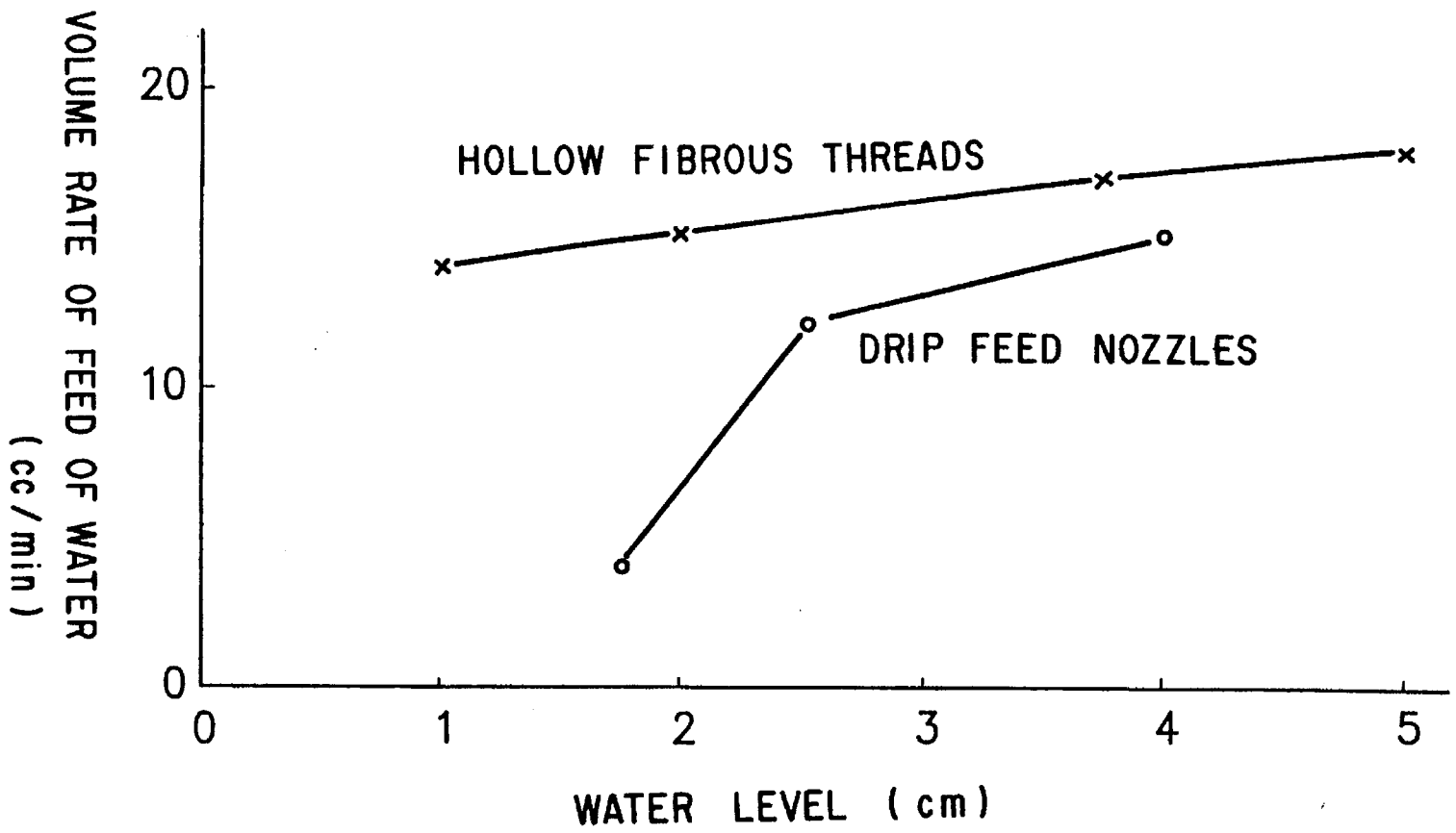
FIG. 3 is a graph diagrammatically illustrating the relationship of the volume rate of drip feed of the water with respect to the level of the water in the inflow reservoir for different types of drip feed members in the above mentioned embodiment of the present invention.

FIG. 3 is a graph showing the relationships of the volume rates of feed of the water with respect to the level of the water in the inflow reservoir 1*a* in case where the drip feed members are each constituted by the dripping nozzle 8 having an inner diameter of 2 mm or the hollow fibrous threads 18 having an outer diameter of 1.9 mm and an inner diameter of 1.0 mm. It has been found that the respective volume rates of water feed are varied in accordance with the level of the water in the inflow reservoir 1*a*.

Figure 4:
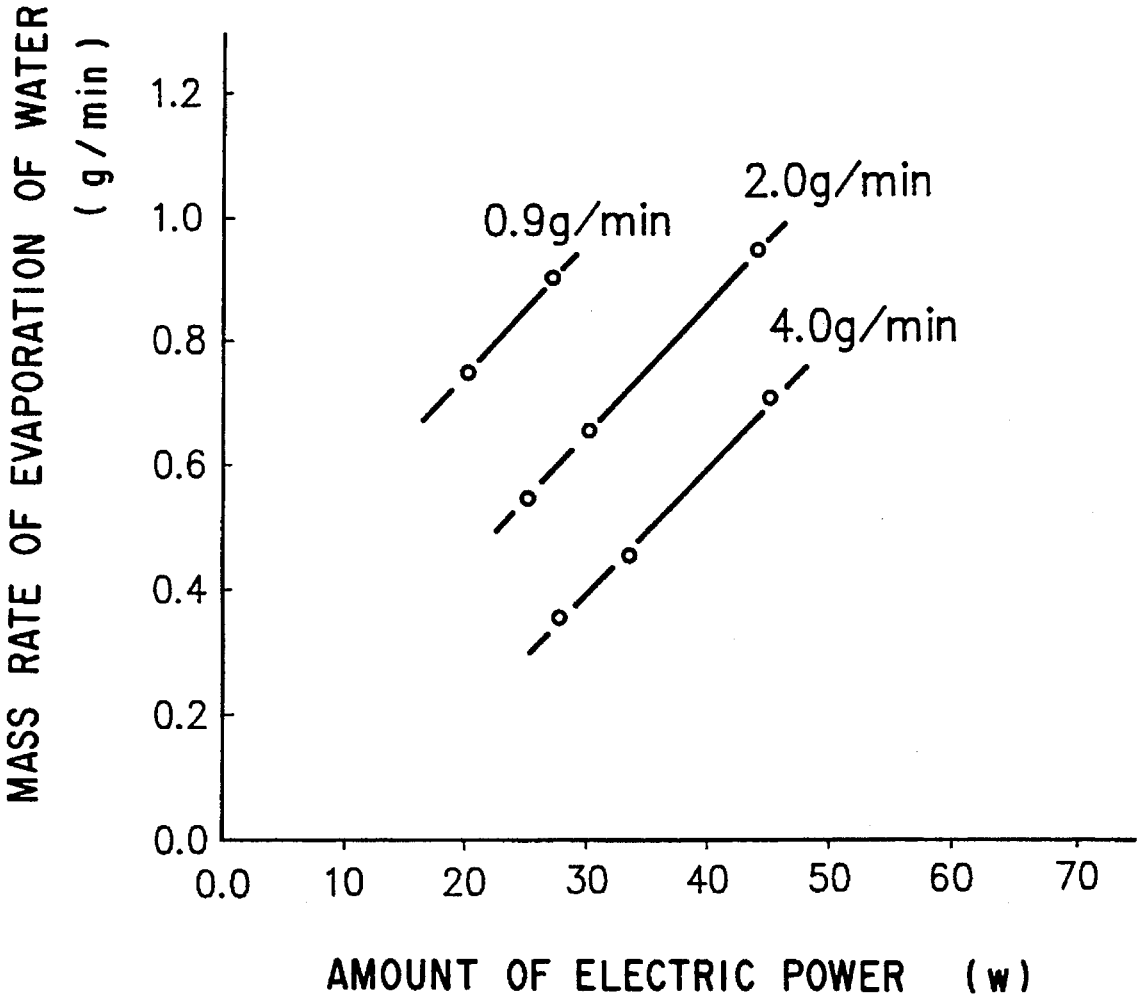
FIG. 4 is a graph illustrating the relationship between the amount of heating electric power in the heating unit and the mass rate of evaporation of the water.

FIG. 4 is a graph showing the relationship of the mass rate of evaporation of the water with respect to the amount of the heating electric power for the humidifier 9. It has been found that for a given amount of electric power, the mass rate of evaporation of the water is largely varied as the volume rate of feed of the water into the humidifier 9 is varied.

While in the above mentioned embodiment of the present invention an example has been shown in which the humidifier 9 utilizing the hollow textile threads is disposed at a downward side of the outflow reservoir 1*b*, it should be noted that an arrangement may be employed in which there is provided in the bottom plate of the outflow reservoir 1*b* a single flow outlet through which a given amount of the water is fed into a boiler type humidifier.

Figure 5:
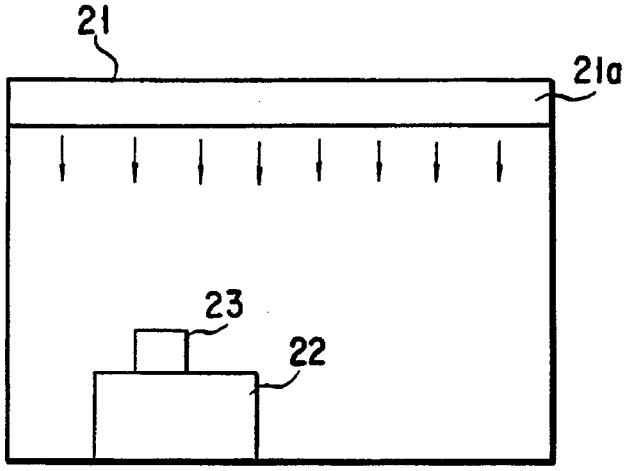
FIG. 5 is a cross sectional view diagrammatically illustrating an example of the use of an air conditioning apparatus according to the present invention.

An explanation will now be given with respect to an air conditioning apparatus which incorporates a water feed device for humidification as mentioned hereinbefore. FIG. 5 shows an example of the use of an air conditioning apparatus according to the present invention. As shown in the Figure, there are arranged a clean room 21 into which the air is introduced via a filter 21*a*, a spin coating unit 22 that is disposed on the floor of the clean room 21, and a built-in air conditioning apparatus 23 that is disposed upon the spin coating unit 22 and that is constructed in accordance with the present invention.

Figure 6:
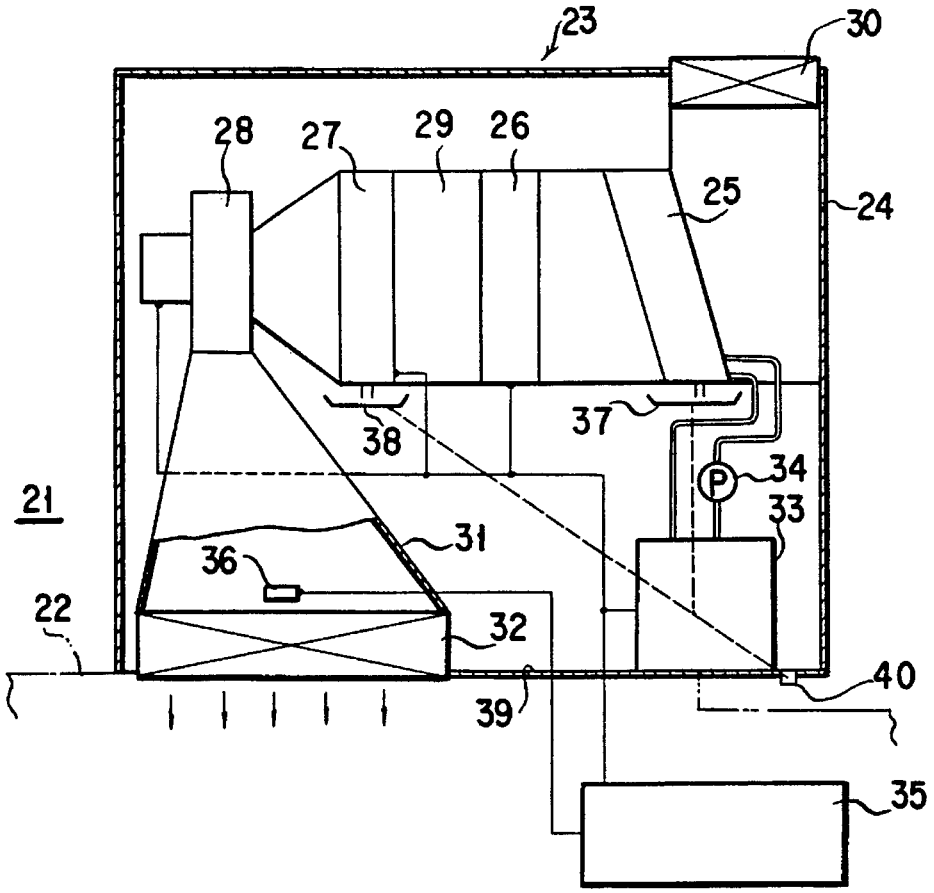
FIG. 6 is a cross sectional view diagrammatically illustrating a first embodiment of the air conditioning apparatus according to the present invention.

The air conditioning apparatus 23 is constructed as shown in FIG. 6 and is provided with a cooling dehumidifier unit 25, a heating unit 26, a humidifier unit 27 and an air blower unit 28 of centrifugal fan type, which are arranged in series in an air duct 29 that is disposed in a horizontal direction within a housing 24. And, the cooling dehumidifier unit 25 is opposed to an inlet side of the air duct 29 that is provided with a preliminary filter 30, and the air blower unit 28 has an outlet side that is connected to an outlet duct 31 which is tapered and is opening expandingly downwards. This outlet duct 31 is opening to the lower surface of the housing 24 via a high performance filter 32, with a portion of the opening being opposed to the area to be air conditioned in the spin coating unit 22. In this connection, it should be noted that there is connected to the humidifier unit 27, a water feed device for humidification as mentioned above.

A cooling water generator 33 is connected via a pump 34 to the cooling dehumidifier 25. This cooling water generator 33 and the heater unit 25, the humidifier unit 27 and the air blower unit 28 mentioned above are connected to a power supply controller 35, which is designed to control each of the above mentioned units in response to a value of detection of a temperature and humidity sensing means 36 that is disposed within the above mentioned outlet duct 31 so that the temperature, humidity and flow rate of the air being fed may be held at respective predetermined values.

Downwards of the cooling dehumidifier unit 25 and the humidifier unit 27 of the air duct 29 mentioned above there are provided, respectively, a pair of water proof trays 37 and 38, which are connected via a pair of hoses 37*a* and 38*b* to the cooling dehumidifier unit 25 and the humidifier unit 27, respectively. Also, a lower portion of the housing 24, except for a region of the outlet duct 31, is entirely sealed in a water tight configuration, and is provided therein with a further water proof tray 39, which is in turn provided with a drainage outlet 40. To this drainage outlet 40 there are connected the above mentioned trays 37 and 38 as well. Also, the said further tray 39 has the above mentioned cooling water generator 33 mounted thereon.

According to the construction mentioned above, the air in the clean room 21 will be sucked from the inlet of the air duct 29 via the preliminary filter 30 by driving the air blower unit 28. In the meantime, a flow of this air, while passing through the air duct 29, will be cooled to be dehumidified at the cooling dehumidifier unit 25, will then be heated by the heater unit 26, will subsequently be humidified by the humidifier unit 27 and, thus upon having been given a predetermined temperature and humidity, will finally be fed from the outlet duct 31 via the high performance filter 32 towards a side of the spin coating unit 22. At this instant, the temperature and the humidity of the air being fed will be detected by the temperature and humidity sensing means 36, and the power supply controller 35 will act to control each of the above mentioned unit in response to a value of the detection made thereby.

In the operation mentioned above, at the side of the cooling dehumidifier unit 25, the moisture in the air that has passed therethrough will be condensed, with the condensed moisture falling through an endothermic member such as a fin, then being received by the water proof tray 37 that is disposed downwards thereof and finally being discharged through the drainage outlet 40 into the outside of the housing 24.

Also, at the side of the humidifier unit 27, in case the water that has been fed there is leaked, any such a leakage will be received in the water proof tray 38 which is provided downwards thereof and will then be discharged through the drainage outlet 40 into the outside of the housing 24.

Furthermore, In case an amount of the water is leaked from the water proof tray 37 or 38 mentioned above or from any conduit reaching there, any such leakage will be received in the further water proof tray 39 which is provided at the low portion of the housing 24 and will then be discharged through the drainage outlet 40 into the outside of the housing 24.

According to the above mentioned construction, it can thus be seen that if water droplets happen to fall by gravity from any of a variety of the components of the air conditioning system including the cooling dehumidifier unit 25, owing to the fact this water is received by the trays 37, 38 or 39 and then discharged out of the housing 24 these droplets may not adhere onto the heating unit 26 or the temperature and humidity sensing means 36 provided in the housing 24 and may not be introduced into the conditioned air flow at the outlet side to produce a clogging of the filter 32 or to induce any other adverse effect; there could be no influence from the moisture condensed water at all; and an increased precision at which a temperature and a humidity are controllable is assured.

Figure 7:
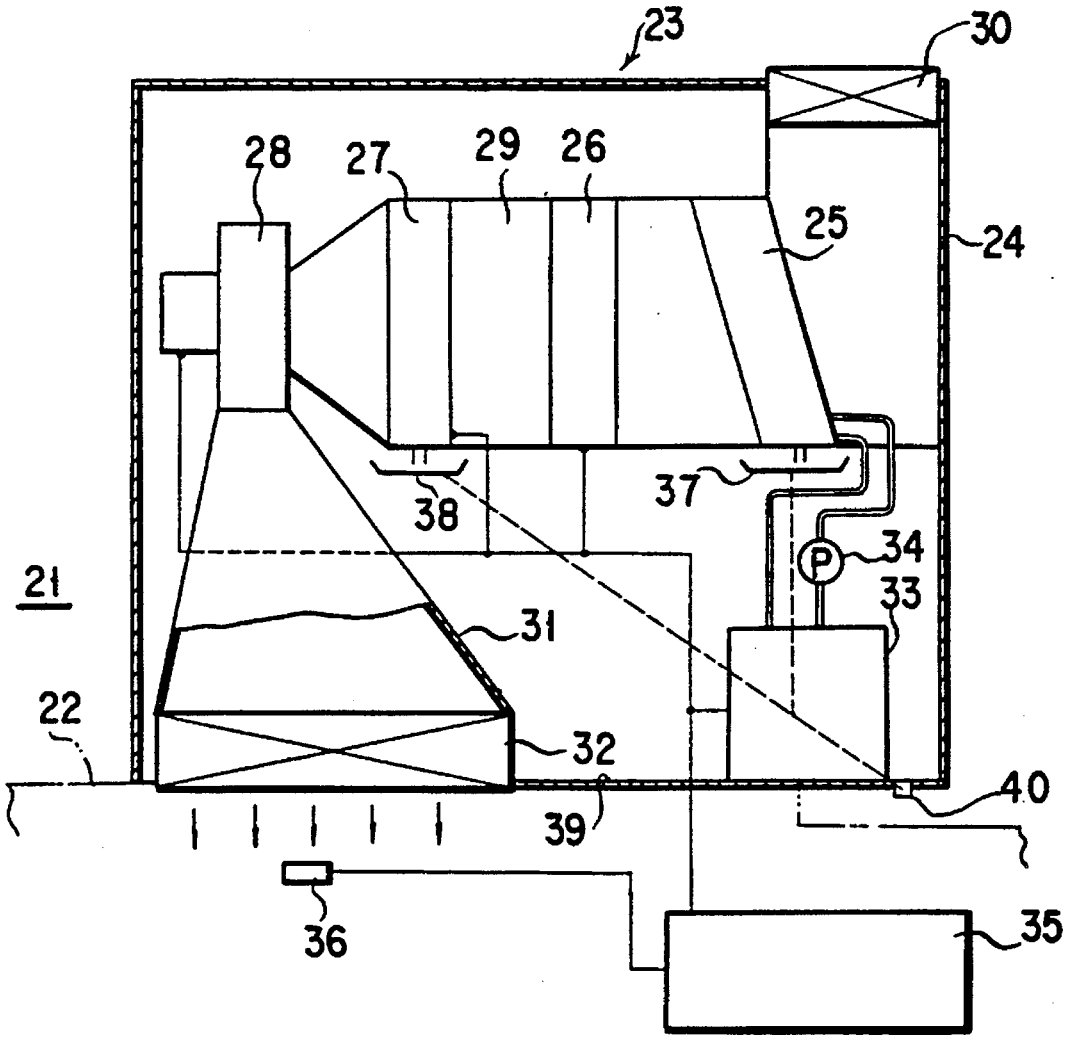
FIG. 7 is a cross sectional view diagrammatically illustrating a second embodiment of the air conditioning apparatus according to the present invention.

Finally it should be pointed out that the temperature and humidity sensing means 36 in an alternative embodiment in contradiction to the embodiment set forth above may be disposed downwards of and in the vicinity of the filter 32 as shown in FIG. 7.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A water feed device for humidification, comprising:

an outflow reservoir that is disposed above a humidifier for feeding water into said humidifier by way of a permeation and that is provided with an overflow dam for maintaining a level of the water in said outflow reservoir substantially constant;

an inflow reservoir that is disposed upwards of said outflow reservoir and that is provided with a flow inlet;

a partition plate that is disposed between said inflow reservoir and said outflow reservoir; and a plurality of drip feed members which are provided in said partition plate for allowing the water in said inflow reservoir to drop by gravity in a form of droplets into said outflow reservoir.

2. A water feed device for humidification as set forth in claim 1, characterized in that said inflow reservoir and said outflow reservoir are each made up from an insulating material; and that said inflow reservoir and said outflow reservoir have each an inner surface that has been treated so as to be hydrophobic.

3. A water feed device for humidification as set forth in claim 1 or claim 2, characterized in that said inflow reservoir is provided therein with a float switch for detecting a level of the water in said inflow reservoir whereas said flow inlet is provided thereat with an on/off valve said on/off valve being controllable in response to a signal from said float switch for controlling a rate of inflow of the water from said flow inlet into said inflow reservoir.

* * * * *